US010301818B1

(12) United States Patent
Harkins

(10) Patent No.: US 10,301,818 B1
(45) Date of Patent: May 28, 2019

(54) INSULATION SUPPORT SYSTEM

(71) Applicant: Daniel J. Harkins, Port Charlotte, FL (US)

(72) Inventor: Daniel J. Harkins, Port Charlotte, FL (US)

( * ) Notice: Subject to any disclaimer, the term of this patent is extended or adjusted under 35 U.S.C. 154(b) by 0 days.

(21) Appl. No.: 15/957,237

(22) Filed: Apr. 19, 2018

(51) Int. Cl.
*E04B 1/24* (2006.01)
*E04B 1/76* (2006.01)
*E04B 7/02* (2006.01)

(52) U.S. Cl.
CPC ..... *E04B 1/7654* (2013.01); *E04B 7/024* (2013.01); *E04B 1/24* (2013.01)

(58) Field of Classification Search
CPC ..... E04B 1/7654; E04B 7/024; E04B 1/24
See application file for complete search history.

(56) References Cited

U.S. PATENT DOCUMENTS 2,749,262 A * 6/1956 Wiser ..... E04B 1/7654 138/DIG. 10
2,782,914 A * 2/1957 Giles ..... E04B 1/7654 428/101
4,233,791 A * 11/1980 Kuhl ..... E04B 1/66 156/71
4,446,664 A 5/1984 Harkins
4,573,298 A 3/1986 Harkins
4,875,320 A * 10/1989 Sparkes ..... E04B 9/001 52/406.1
5,901,518 A 5/1999 Harkins
7,913,842 B2 * 3/2011 Evans ..... B65D 75/5827 206/388
8,333,279 B2 * 12/2012 Veiseh ..... B65B 5/067 206/524.8
8,590,245 B2 * 11/2013 Peng ..... E04D 13/1618 52/404.3
9,920,517 B2 * 3/2018 Sollie ..... E04B 1/767
2004/0185225 A1 * 9/2004 Fay ..... E04B 1/767 428/126
2009/0314672 A1 * 12/2009 Evans ..... B65D 75/5827 206/321
2011/0061311 A1 * 3/2011 Peng ..... E04D 13/1618 52/23
2018/0051460 A1 * 2/2018 Sollie ..... E04B 1/767

* cited by examiner

*Primary Examiner* — Rodney Mintz
(74) *Attorney, Agent, or Firm* — Donald J. Ersler

(57) ABSTRACT

An insulation support system preferably includes an edge-folded ceiling liner sheet, an encapsulated package and a plurality of compressible thermal spacers. The edge-folded ceiling liner sheet includes opposed folded-up edges. The folded-up edges have sufficient length to clear pinch points along structural beams. Opposing folded-up edges of the edge-folded ceiling liner sheet are creased on the fold to fit in the encapsulated package. The edge-folded ceiling liner sheet is fan-folded for retention in the encapsulated package. A sheet slot is formed through at least one lengthwise sidewall of the encapsulated package. A removable edge seal strip is applied over the sheet slot. A compressible thermal spacer includes a snap clip and a compressible insulation material. A bottom of the compressible insulation material is bonded to a top of the snap clip. The snap clip is attached to a top flange of a purlin eliminating the need for exposed roof insulation.

6 Claims, 6 Drawing Sheets

INSULATION SUPPORT SYSTEM

BACKGROUND OF THE INVENTION

1. Field of the Invention

The present invention relates generally to buildings and more specifically to an insulation support system, which avoids frequent pinch points along primary structural beams.

2. Discussion of the Prior Art

Insulation systems for buildings with primary roof beams attached and supported by columns attached to a foundation with bolts, and which buildings have secondary structural members substantially perpendicular to and supported by the primary rafter beams and columns, also known as metal buildings have been developing to achieve higher thermal insulating performances as disclosed in U.S. Pat. Nos. 4,446,664, 4,573,298 and 5,901,518 to Harkins. The basic concepts are to use methods and structures to retain the insulation materials of various types with greater thicknesses and with minimal compression. Insulative materials generally have thermal resistances that are determined by the installed thickness of the insulative materials used. Various methods and structures have been devised to create support structures for the insulation materials, which create space for greater thicknesses of insulation materials in these building roofs and walls. Some of these methods employ very large pieces of flexible sheet materials that are custom prefabricated to fit between each of the building's primary structural beam spacings and span below a plurality of perpendicular secondary structural members without the need for seams to be made at each secondary structural member as contained in prior art.

The prior art uses of a lattice of straps, wires, ropes or bands to create a lattice support structure, which spanned between the primary support beams or rafters, was installed to support the large pieces of flexible sheet material as it was installed, fastened into position and then sealed along the edges of the sheet material. The installations of the support platform and the large flexible sheet is typically done in sequence with the insulation materials and roof materials. These methods and structures used to practice these inventions are typically done in exposed exterior conditions which have wind, rain, snow and other weather related phenomena, which adversely affect the materials used: the productivity of the installers; the quality of the installed flexible sheet materials; and resulting insulation performance.

During installation, the exposed flexible sheet materials are easily caught by wind during installation and also can collect rain, sleet and snow during the process of installation of the large flexible sheets of materials, which are custom pre-fabricated to fit entire building bay areas between two adjacent primary rafter beams, and a plurality of secondary structural members which often cover the entire width of the building between the two opposing sidewalls in one continuous seamless piece. Insulation is typically two layers with the bottom layer placed between the secondary structural members and supported directly on the flexible sheet material, which is in turn supported by the lattice of straps, wires, ropes or bands which retain the flexible sheet material below the bottom plane of the secondary structural members. A second layer of insulation, which is typically in a blanket form is placed over the upper side secondary structural members and the first layer of insulation which is between the purlins. Roofing panels are typically installed over the top of the insulation and fastened to form the building roof.

The insulation typically fills the space between the flexible material supporting the insulation and the underside of the roof panels. The second insulation layer is sandwiched between the tops of the secondary structural members and the underside of the roof panels. This second layer of insulation serves to break the conductive contact between the thermally conductive secondary structural members, which are typically steel and the conductive metal roof panels, which may be made of steel, aluminum, or other material.

Installing the thicker insulation which is typically two insulation layers and their support system is more time consuming than that of the prior art, which was typically draping one thin layer of faced insulation over the tops of the secondary structural members, compressing it under the roof panels and fastening the panels down. The extra time required to install an insulation support system and three hundred percent more insulation thickness has resulted in additional exposure to weather elements which have resulted in the need for improvements in the insulation systems of these buildings, which speed up the installation, reduce the exposure time to weather, reduce potential project delays and improve the quality of the installations and their ultimate thermal performance.

So there is a need for an improved system that reduces exposure to weather, speeds up the installation time and provide new structures that provide better options for contractors to select from for their particular project environment.

There is a need for an insulation system with an encapsulated ceiling liner sheet which preserves the ceiling liner sheet in a uniform, fan-folded form inside of an encapsulating package whereby the package is not only used for protecting the ceiling liner sheet in the perfect fan-folded (pleat) format from the point of manufacture to the point of clamping the ceiling liner sheet in final position. Prior art systems required the ceiling liner sheet to be removed from it's wrapping and the unwrapped ceiling liner sheet folds are all exposed to the wind and unprotected as the fan-folded ceiling liner sheet is unwrapped and positioned on the lattice platform of straps between two adjacent secondary structural members. The ceiling liner sheet is typically difficult to keep in the neat fan-folded format as there is nothing to hold it neatly in position as the top end of the sheet is pulled off the folded pile of ceiling liner sheet. Wind often disturbs the fan-folded ceiling liner sheet during the process causing it to unfold and catch on the roof structural members. This then requires additional workmen to hold, release and guide the fan-folded ceiling liner sheet one fold at a time as the top end of the ceiling liner sheet is pulled off the pleat-folded pile and across the lattice support platform.

Another problem that is routinely encountered is the ceiling liner sheet is wider than the distance between the two adjacent rafter beam edges. The extra width is required to lap and seal the side edges of the ceiling liner sheet to the top of both of the adjacent primary structural beams, also referred to as building rafters. This extra width occasionally catches in pinch-points where the secondary structural members and purlins are attached to top sides of the primary structural beams (rafters).

Accordingly, there is a clearly felt need in the art for an insulation support system, which avoids frequent pinch points along primary structural beams.

SUMMARY OF THE INVENTION

The present invention provides an insulation support system, which avoids frequent pinch points along primary structural beams. The insulation support system preferably includes an edge-folded ceiling liner sheet, an encapsulated package and a plurality of compressible thermal spacers. The edge-folded ceiling liner sheet having opposing side edges folded back over a ceiling liner sheet edge, a distance sufficient for the folded edge to clear the frequent pinch points along both adjacent primary structural beams. The opposing edge folds of the ceiling liner sheet are creased on the fold to hold the proper fold distance dimension throughout the installation on a lattice support platform of crossing support straps to avoid the pinch points as well as fit neatly into the encapsulated package. The edge-folded ceiling liner sheet is fan-folded in a dimension sufficient to be retained in an encapsulated package; and the folded edges are inside the opposite two narrower ends of the encapsulated package.

At least one of the long edges includes a sheet slot formed through a sidewall of the encapsulated package. The sheet slot is covered with a removable edge seal strip. The edge seal strip is removed once the encapsulated package containing the neatly fan-folded ceiling liner sheet is placed into position on the lattice platform between the chosen secondary structural members, typically along the building eave line or ridge line. When workmen are ready to pull out the ceiling liner sheet in the desired building bay, between two adjacent primary structural beams, the removable edge strip is pulled off the encapsulated package and two crew men take only the opposing top corners of the ceiling liner sheet out of the encapsulating package and quickly pull the ceiling liner sheet out below the secondary structural members on the top side of the lattice platform without any adverse effects of wind and without the fan-folds and edges being caught at pinch points. The fan-folded ceiling liner sheet remains protected inside the encapsulated package out of any wind and potential weather exposures. A board or other weight can be placed on the top of the encapsulated package to provide a desired degree of resistance to the fan-folded ceiling liner sheet from being pulled out of the encapsulated package.

Another option is to clamp two opposing top end corners of the ceiling liner sheet at the beginning end to the building structural member and then pull the encapsulated package along on the lattice platform as the ceiling liner sheet pulls out of the encapsulated package. The length of the encapsulated package is less than the distance between the two adjacent primary structural members to avoid any interference with pulling the encapsulated package or sheet along on the lattice platform. With either option, once the ceiling liner sheet is pulled in and clamped securely in position, the bottom side fasteners are installed to attach the lattice platform to the bottoms of the secondary structural members with fasteners penetrating through the ceiling liner sheet at those points. The ceiling liner sheet folded edges are unfolded and sealed to the top flanges of the primary structural members.

It is an option to install the insulation from the interior of the building after the roof panels are installed. For this option to be used, there is a need for a compressible thermal spacer material to be installed on top of the secondary structural members, before the roof panels are applied. The compressible thermal spacer is shaped in a clam-shell like shape with compressible material attached to the upper surface and which slides on to the secondary structural member and provides a conductive thermal break as well as dampens any roof noise from rain and wind actions on the roof panels. Roof panels must be prevented from flexing by use of the compressible material to prevent noises, which can be very load, thunder-like sounds and very annoying.

More stringent energy conservation codes are requiring much greater insulation thicknesses with greater insulation performances in building roofs and walls. These greater stringencies require different methods, which create space for greater thicknesses of insulation necessary to meet and exceed the higher thermal insulation requirements. Typically, a sheet material is adhered or laminated to an insulation material such as fiberglass. This laminated insulation sheet material is installed between the exterior roof structural members and supported by steel support straps which are installed substantially perpendicular, across the underside of the roof structural members such as metal building roof purlins. The side edges and end butt junctions of each of the individual laminated insulation sheet materials are then required to be sealed together over the tops of roof structural members, which is practically and economically not possible to seal effectively. This sealing of the sheet material is to resist air leakage due to pressure differences and convection currents to achieve optimal thermal performance of the insulation and to prevent condensation within the insulation. Methods that place the vapor retarders over the upper surfaces of the roof structural members, leave the bottom and sides of the structural members subject to significant conduction and radiation of heat energy and promote condensation and corrosion.

Accordingly, it is an object of the present invention to provide an insulation system utilizing edge-folded ceiling liner sheets to support insulation, which avoids frequent pinch points along primary structural beams; prevents damage to the ceiling liner sheet during installation processes; and provides a practical means to unfold and seal the ceiling liner sheet edges, which effectively isolates all secondary structural members from the conditioned space below.

These and additional objects, advantages, features and benefits of the present invention will become apparent from the following specification.

DETAILED DESCRIPTION OF THE PREFERRED EMBODIMENTS

Figure 1:
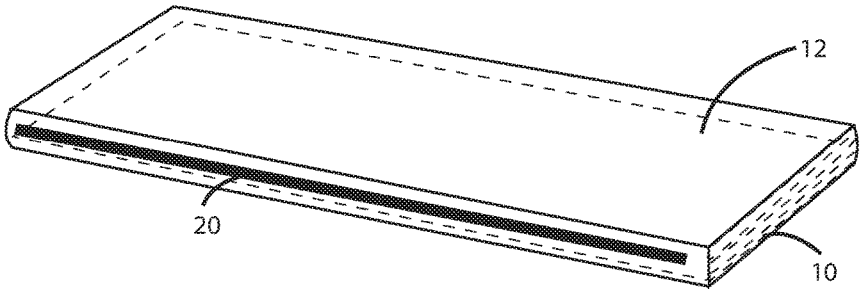
FIG. 1 is a perspective view of an encapsulated package of an insulation support system in accordance with the present invention.
Figure 2:
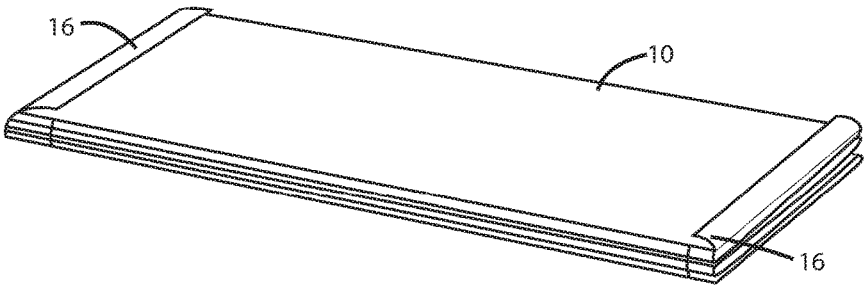
FIG. 2 is an edge-folded ceiling liner sheet removed from an encapsulated package of an insulation support system in accordance with the present invention.
Figure 3:
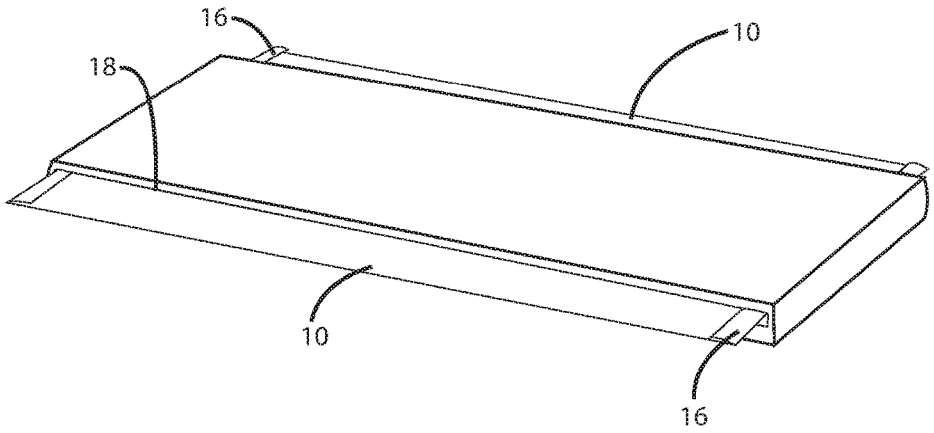
FIG. 3 is a perspective view of an encapsulated package with opposing edges of an edge-folded ceiling liner sheet extending from opposing ends of the encapsulated package of an insulation support system in accordance with the present invention.

With reference now to the drawings, and particularly to FIG. 1, there is shown a perspective view of an encapsulated package of an insulation support system. With reference to FIGS. 1-3, 5 and 11, the insulation support system preferably includes an edge-folded ceiling liner sheet 10, an encapsulated package 12 and a clip-on compressible thermal spacer 22. The encapsulated package 12 is also protected from the weather. The edge-folded ceiling liner sheet 10 includes opposed folded-up edges 16. With reference to FIG. 5, the folded-up edges 16 have sufficient length to clear the frequent pinch points along both adjacent primary structural beams. The opposing folded-up edges 16 of the edge-folded ceiling liner sheet 10 are creased on the fold to fit neatly into the encapsulated package 12. The encapsulated package 12 has a substantially rectangular shape. The edge-folded ceiling liner sheet 10 is fan-folded in a dimension sufficient to be retained in the encapsulated package 12. An example of a fan-folded ceiling liner sheet 10 cannot be shown in FIGS. 1-4, because of size limitations. However, item 26 in FIG. 11 includes an example of a fan-folded sheet. With reference to FIGS. 1 and 3, a sheet slot 18 is formed through at least one lengthwise sidewall of the encapsulated package 12. A removable edge seal strip 20 is applied over the sheet slot 18, until removal of the edge folded ceiling liner sheet 10 from the encapsulated package 12.

With reference to FIGS. 3-7, the encapsulated package 12 is placed between purlins 102 or eave purlins 104 of a building support structure 100 on top of a plurality of support straps 106 (lattice support). The purlins 102, 104 are supported by rafters 108. When workmen are ready to pull out the edge-folded ceiling liner sheet 10 in a desired building bay, between two rafters 108, the removable edge strip 20 is pulled off the encapsulated package 12 and two crew men take only the opposing top corners of the edge-folded ceiling liner sheet 10 out of the encapsulated package 12 and quickly pull the edge-folded ceiling liner sheet 10 out below the purlins 102 (secondary structural members) on a top side of the plurality of support straps 106 (lattice support) without worrying about the edge-folded ceiling liner sheet 10 being subject to a gust of wind, or folded-up edges 16 being caught at pinch points. An unused portion of the edge-folded ceiling liner sheet 10 remains protected in the encapsulated package 12. The fan-folded ceiling liner sheet 10 remains protected inside the encapsulated package 12 out of any wind and potential weather exposures. A board or other weight can be placed on the top of the encapsulated package 12 to provide a desired degree of resistance to the edge-folded ceiling liner sheet 10 within being pulled out of the encapsulated package 12.

Figure 4:
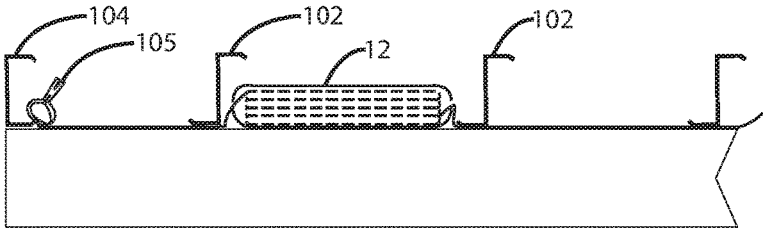
FIG. 4 is an end view an encapsulated package located between two adjacent purlins with an edge-folded ceiling liner sheet extending from opposing lengthwise sides of the encapsulated package of an insulation support system in accordance with the present invention.
Figure 5:
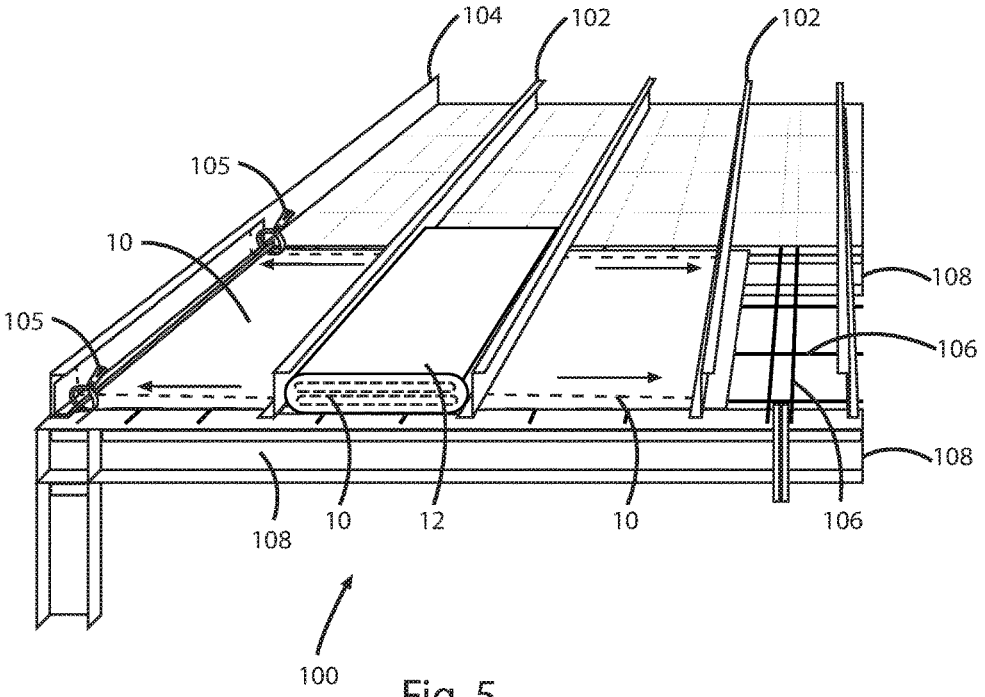
FIG. 5 is a perspective view an encapsulated package located between two adjacent purlins with an edge-folded ceiling liner sheet extending from opposing longwise sides of the encapsulated package of an insulation support system and a second edge-folded ceiling sheet installed, adjacent to encapsulated package in accordance with the present invention.
Figure 6:
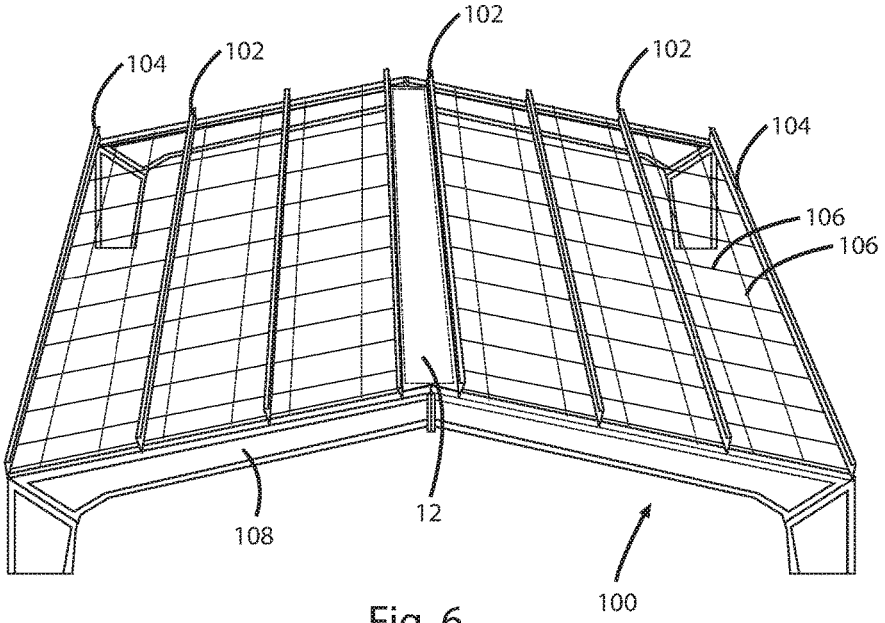
FIG. 6 is a perspective view a top of a metal building with an encapsulated package located between two adjacent purlins at a ridge thereof of an insulation support system in accordance with the present invention.
Figure 7:
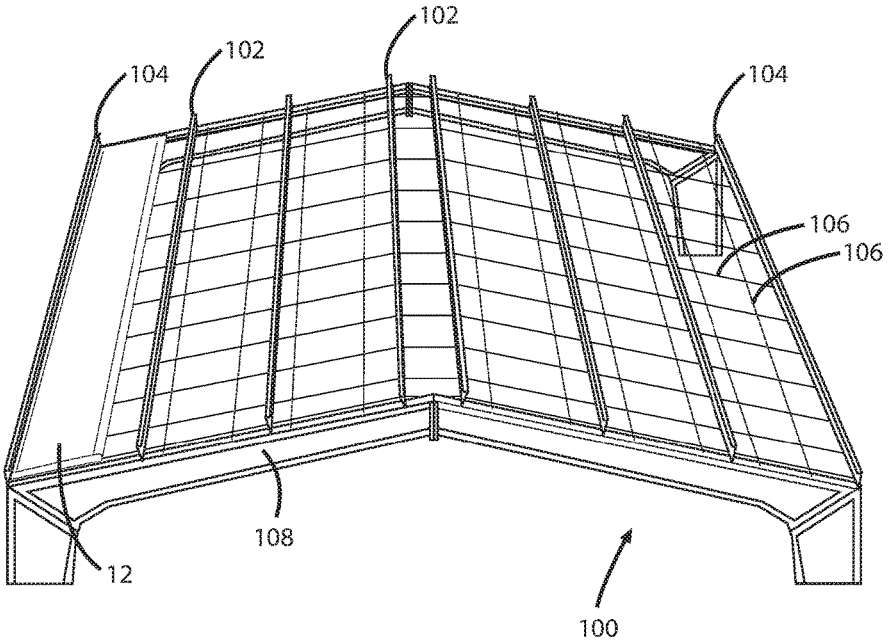
FIG. 7 is a perspective view a top of a metal building with an encapsulated package located between an eave purlin and a regular purlin of an insulation support system in accordance with the present invention.
Figure 8:
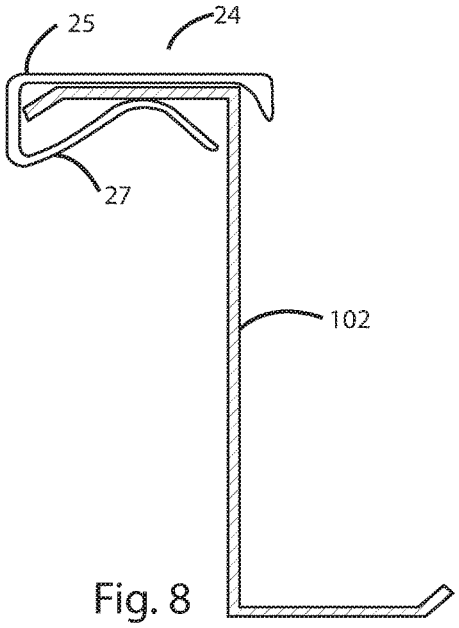
FIG. 8 is an end view of a snap-on clip of a compressible thermal spacer, compressible insulation not shown, for attachment to a purlin of an insulation support system in accordance with the present invention.
Figure 9:
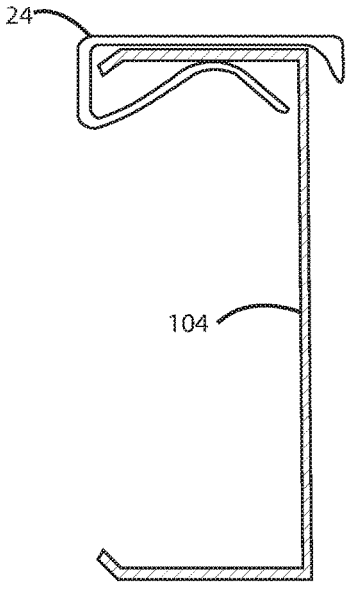
FIG. 9 is an end view of a snap-on clip of a compressible thermal spacer, compressible insulation not shown, for attachment to an eave purlin of an insulation support system in accordance with the present invention.

With reference to FIGS. 4-5, another option is to clamp two opposing top end corners of the edge folded ceiling liner sheet 10 at the beginning end to the eave purlin 104 (secondary structural member) with C-clamp vise grips 105 and then pull the encapsulated package 12 on the plurality of support straps 106 (lattice support) as the edge-folded ceiling liner sheet 10 dispenses out of a trailing side of the encapsulated package 12. A length of the encapsulated package 12 is less than a distance between the two adjacent rafters 108 (primary structural members) to avoid any interference with pulling the package or sheet along the plurality of support straps 106 (lattice support). With either option, once the edge-folded ceiling liner sheet 10 is pulled into position and clamped securely in position. Bottom side fasteners are installed to attach the plurality of support straps 106 to bottoms of the purlins 102 with fasteners penetrating through the edge-folded ceiling liner sheet 10 at those points. The folded-up edges 16 are unfolded and sealed in final position to top flanges of the rafters 108.

Figure 10:
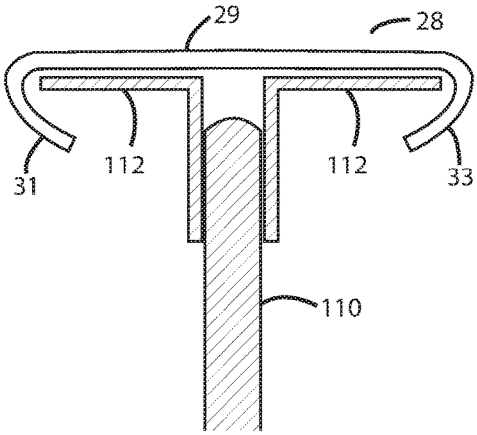
FIG. 10 is an end view of a rafter snap-on clip of a compressible thermal spacer, compressible insulation not shown, for attachment to a double flange purlin of an insulation support system in accordance with the present invention.
Figure 11:
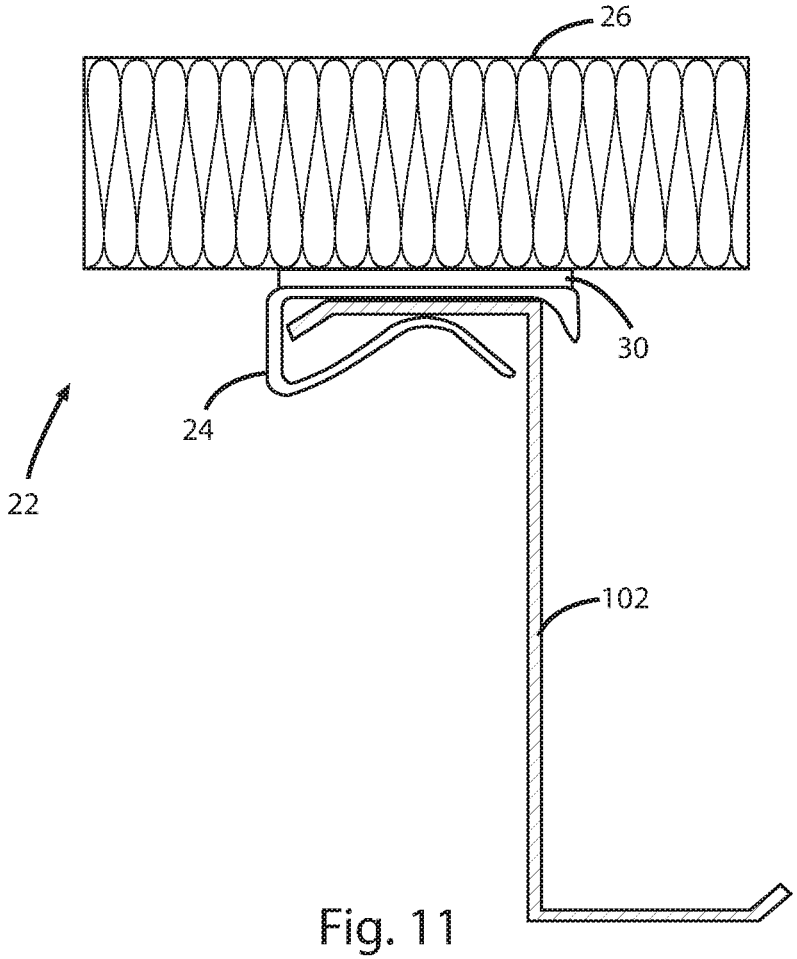
FIG. 11 is an end view of a snap-on clip of a compressible thermal spacer, with compressible insulation shown, attached to a purlin of an insulation support system in accordance with the present invention.

It is an option to install insulation from the interior of the building after the roof panels are installed. With reference to FIGS. 8-11, for this option to be used, there is a need for the clip-on compressible thermal spacer 22. The clip-on compressible thermal spacer 22 preferably includes a snap clip 24 or any other suitable attachment device and a compressible insulation material 26. The snap clip 24 preferably includes a upper leg 25 and a lower leg 27. An end of the upper leg 25 is joined to an end of the lower leg 27. The snap clip 24 is fabricated from a material with memory properties. A bottom of the compressible insulation material 26 is preferably adhered to the upper leg 25 of the snap clip 24 with adhesive 30. The snap clip 24 is preferably attached to a top flange of a purlin 102, 104, before the roof panels are applied. With reference to FIG. 10, a double flange purlin 110 is shown with a snap clip 28 attached to two opposing upper flanges 112. The snap clip 28 includes a base member 29, a first end member 31 and a second end member 33. The first end member 31 extends from a first end of the base member 29 and the second end member 33 extends from a second end of the base member 29. The compressible insulation material 26 is adhered to the base member 29 of the snap clip 28 with adhesive 30. The snap clip 24, 28 also provides a conductive thermal break as well as dampens any roof noise or roof rumble from rain and wind actions from the roof panels or building movements. Roof panels will flex during a high wind or fluctuating wind, which can result in very annoying thunder-like noises.

The installation of these improvements to metal buildings allow for the rapid enclosure of the building with the least adverse effects of wind and other weather variables as the insulation can be substantially installed from the interior of the building by installing insulation on the edge folded ceiling liner sheet 10 over the rafters 108 to fill all cavities under the roof between two adjacent rafters 108 without adverse effects of weather on the qualities of performance or the insulation installation productivity.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An edge-folded ceiling liner sheet for installation over one of a plurality of straps and a support structure located below a bottom of one of primary and secondary structural members of a metal building comprising:

a length of a first sheet material having opposed first folded-up edges formed along said length thereof, wherein said length of said first sheet material being fan-folded with said opposed first folded-up edges, said first sheet material is laid on the one of the plurality of straps and the support structure, the one of the plurality of straps and the support structure supports substantially all of a bottom surface area of the first sheet material; and a length of a second sheet material having opposed second folded-up edges, wherein said length of said second sheet material is laid on the one of the plurality of straps and the support structure such that one of said second folded-up edges is adjacent one of said first folded-up edges, the one of the plurality of straps and the support structure supports substantially all of a bottom surface area of the second sheet material, wherein said one of said first folded-up edges and said one of said second folded-up edges are unfolded to overlap each other.

2. The edge-folded ceiling liner sheet of claim 1 wherein:

said folded-up edges are creased.

3. An encapsulated package for retaining a ceiling liner sheet for installation over one of a plurality of straps and a support structure located below a bottom of one of primary and secondary structural members of a metal building, comprising:

a substantially rectangular package having a sheet slot formed through at least one lengthwise package wall, said sheet slot is parallel with a length of said substantially rectangular package;

a length of sheet material having opposed folded-up edges formed along said length thereof, said length of sheet material being fan-folded with said opposed folded-up edges to fit inside said substantially rectangular package, said length of sheet material is retained inside said substantially rectangular package, wherein said opposed folded-up edges are unfolded after removal from said substantially rectangular package; and a removable edge seal strip is applied over said sheet slot.

4. The encapsulated package for retaining a ceiling liner sheet of claim 3 wherein:

said folded-up edges are creased.

5. An encapsulated package for retaining a ceiling liner sheet for installation over one of a plurality of straps and a support structure located below a bottom of one of primary and secondary structural members of a metal building, comprising:

a substantially rectangular package having a sheet slot formed through at least one lengthwise package wall, said sheet slot is parallel with a length of said substantially rectangular package;

a length of sheet material having opposed folded-up edges formed along said length thereof, said length of sheet material being fan-folded with said opposed folded-up edges to fit inside said substantially rectangular package, said length of sheet material is retained inside said substantially rectangular package, wherein said opposed folded-up edges are unfolded after removal from said substantially rectangular package, said substantially rectangular package allows only a portion of said length of sheet material to be exposed to wind during installation of said length of sheet material; and a removable edge seal strip is applied over said sheet slot.

6. The encapsulated package for retaining a ceiling liner sheet of claim 5 wherein:

said folded-up edges are creased.

* * * * *